US010480885B2

(12) United States Patent
Mohler et al.

(10) Patent No.: US 10,480,885 B2
(45) Date of Patent: Nov. 19, 2019

(54) SOUND SUPPRESSOR

(71) Applicant: Spectre Enterprises, Inc., Melbourne, FL (US)

(72) Inventors: Timothy Mohler, Palm Beach Gardens, FL (US); Daniel Yates, Jacksonville, FL (US)

(73) Assignee: SPECTRE ENTERPRISES, INC., Melbourne, FL (US)

( * ) Notice: Subject to any disclaimer, the term of this patent is extended or adjusted under 35 U.S.C. 154(b) by 0 days.

(21) Appl. No.: 15/813,091

(22) Filed: Nov. 14, 2017

(65) Prior Publication Data

US 2018/0164065 A1 Jun. 14, 2018

Related U.S. Application Data

(60) Provisional application No. 62/446,714, filed on Jan. 16, 2017, provisional application No. 62/421,986, filed on Nov. 14, 2016.

(51) Int. Cl.
*F41A 21/30* (2006.01)

(52) U.S. Cl.
CPC ..... *F41A 21/30* (2013.01)

(58) Field of Classification Search
CPC ..... F41A 21/30
USPC ..... 89/14.4; 181/223
See application file for complete search history.

(56) References Cited

U.S. PATENT DOCUMENTS 4,588,043 A 3/1986 Finn
5,164,535 A 11/1992 Leasure
6,575,074 B1 6/2003 Gaddini
7,073,426 B1 7/2006 White
7,587,969 B2 9/2009 Silvers
7,874,238 B2 1/2011 Silvers
7,931,118 B1 4/2011 Cronhelm
D651,680 S 1/2012 DeGroat
8,096,222 B2 1/2012 Silvers
8,307,946 B1 11/2012 Johnston
8,397,615 B2 3/2013 Poling
8,424,635 B1 4/2013 Klawuna
8,453,789 B1 6/2013 Honigmann et al.
8,479,632 B2 7/2013 Kline et al.
(Continued)

FOREIGN PATENT DOCUMENTS

DE 202016001721 U1 3/2016
EP 2325594 A2 5/2011
RU 2437048 C1 † 12/2011

OTHER PUBLICATIONS

Third Party Submission under 37 CFR 1.290, filed Jul. 27, 2018.*
(Continued)

*Primary Examiner* — Bret Hayes

(74) *Attorney, Agent, or Firm* — William F. Lang, IV; Lang Patent Law LLC

(57) ABSTRACT

One example of a sound suppressor for a firearm includes a tubular housing and a plurality of individual tubular baffle elements that fit within the tubular housing to form a baffle assembly having a symmetrical or an asymmetrical baffle structure. Different examples of the tubular baffle elements may abut each other or may interlock with each other. Another example of the sound suppressor includes an outer housing that resists passage of heat therethrough.

11 Claims, 9 Drawing Sheets

(56) References Cited

U.S. PATENT DOCUMENTS

| | | | | |
|---|---|---|---|---|
| 8,567,556 | B2 † | 10/2013 | Dueck | |
| 8,579,075 | B2 | 11/2013 | Brittingham et al. | |
| 8,794,376 | B2 | 8/2014 | Shults et al. | |
| 8,807,005 | B2 | 8/2014 | Moss et al. | |
| D712,997 | S | 9/2014 | Proske | |
| 8,950,310 | B2 | 2/2015 | Storrs et al. | |
| 9,038,771 | B1 | 5/2015 | Mueller | |
| 9,086,248 | B2 | 7/2015 | Young et al. | |
| 9,097,482 | B1 | 8/2015 | Holden et al. | |
| 9,175,920 | B2 | 11/2015 | Moore | |
| 9,316,456 | B1 | 4/2016 | Oliver | |
| 9,347,727 | B1 | 5/2016 | Cler | |
| 9,395,136 | B1 | 7/2016 | Kovalov | |
| 9,423,198 | B1 | 8/2016 | Oliver | |
| 9,470,466 | B2 | 10/2016 | Washburn, III et al. | |
| 9,835,399 | B1 * | 12/2017 | Lessard | F41A 21/34 |
| 2005/0208851 | A1 | 9/2005 | Gooliak | |
| 2007/0107590 | A1 | 5/2007 | Silvers | |
| 2011/0132683 | A1 * | 6/2011 | Miller | F41A 21/30 181/223 |
| 2013/0312592 | A1 | 11/2013 | Storrs et al. | |
| 2015/0001001 | A1 | 1/2015 | Wilson | |
| 2015/0292829 | A1 | 10/2015 | Pietila | |
| 2016/0054086 | A1 | 2/2016 | Westlake | |
| 2016/0187093 | A1 | 6/2016 | Barrett | |
| 2016/0209151 | A1 | 7/2016 | Smith | |
| 2017/0299291 | A1 * | 10/2017 | Spector | F41G 11/003 |

OTHER PUBLICATIONS

Howard D. Kent, 18305—Thermal Isolation for Integrally Suppressed Weapons, 2016.

Philip H. Dater, Firearm Sound Suppression Part 2: Suppressor Designs, 2017.

David Crane, "Operator Suppressor Systems/OSS Mission Muzzle Cans: Almost No Black Pressure Yields More Hits on Target and Longer Weapon Life," Defense Review, Dec. 16, 2014.

Steve Coulston, Operator Suppressor Systems: "OSS Introduces the Next Generation of Firearm Sound Suppressors," Guns & Tactics, Jan. 29, 2016, http://www.gunsandtactics.com/o.

International Search Report and Written Opinion for PCT/US2017/061647, dated Mar. 23, 2018.

Thermal Cloak Prevents Weapon Detection by Thermal Imagers.†

* cited by examiner
† cited by third party

SOUND SUPPRESSOR

CROSS REFERENCE TO RELATED APPLICATION

This application claims the benefit of U.S. Provisional Patent Application No. 62/446,714, which was filed on Jan. 16, 2017, and which has the title "Sound Suppressor." This application further claims the benefit of U.S. Provisional Patent Application No. 62/421,986, which was filed on Nov. 14, 2016, and which has the title "Sound Suppressor."

TECHNICAL FIELD

The present invention relates to sound suppressors for firearms.

BACKGROUND INFORMATION

Sound suppressors for firearms generally operate by receiving a bullet after it exits the muzzle of the firearm, as well as the expanding gases that drive the bullet. The gases expand into a series of chambers before the bullet exits the sound suppressor, so that the noise of the bullet exiting the assembly of the firearm and sound suppressor is reduced. The muzzle flash is also reduced. Presently available sound suppressors are complex and expensive to manufacture, generate significant backpressure during use, and may also generate a thermal signature that can be spotted using infrared optical devices.

U.S. Pat. No. 8,479,632 discloses a firearm silencer and methods of manufacturing and fastening the silencer onto a firearm. The suppressor includes an outer housing having an interior threaded proximal end and a radially closed distal end with a bore. A barrel nut is provided on the proximal end of the baffle, having a barrel bore and an externally threaded circumference. The proximal end of the buffer of the baffle assembly is structured to attach to the muzzle of a firearm barrel. The baffle includes a plurality of the V-shaped baffle walls having a central through bore, and defining a number of baffle chambers therebetween. The baffle chamber walls are symmetrical. Some examples of the silencer are designed for insertion of the distal end of the barrel into the proximal end of the baffle. In assembling the suppressor, after attachment of the baffle to the barrel, the can is secured over the baffle using the external threads of the barrel nut.

Making the baffle of U.S. Pat. No. 8,479,632 begins with extruding a rectangular box. An extrusion die is shaped to create a rectangular box having baffle chambers therein. Separate baffle preforms are cut from the extruded sheet. Each preform is turned to provide a circular exterior. A hole is drilled through the center of the baffle. This hole may be counterbored to accommodate the firearm barrel. An interior thread is created at an interior portion of the proximal baffle adapter area for receiving the barrel. An external thread is created on outside portion of the proximal baffle for securing the housing to the baffle.

The suppressor of U.S. Pat. No. 8,479,632 includes large baffle chambers to increase the degree of sound reduction. A semicircular flange at the distal end of the suppressor acts as a muzzle brake, directing expanding outlet gases substantially into the upper hemisphere, forcing the barrel to tip downward. The silencer takes advantage of the portion of the housing and baffle surrounding the barrel to form a relatively large first baffle chamber. Directing the gases rearward into the first baffle chamber also serves as a muzzle brake. By extending a portion of the silencer around the barrel of the firearm, and placing the first baffle chamber therein, a much longer suppressor may be utilized without significantly increasing the overall length of the firearm with the suppressor attached. Since the suppressor also becomes the handguard for the firearm, Pica tinny rails or other mounting surfaces may be provided on the exterior of the housing.

U.S. Pat. No. 7,073,426 discloses a sound, flash, and recoil suppressor for a firearm. The suppressor includes an outer tube having rear and front end caps secured thereto. The first blast baffle is an asymmetrical baffle having a central hole and one or more outer holes. Subsequent baffles are asymmetrical, consisting of plates that are positioned at an angle between 20° and 80° to the suppressor axis. The asymmetrical baffles are either parallel to each other, or may vary in alignment by as much as 10° from each other. Asymmetrical baffles are asserted to produce high levels of turbulence within the sound suppressor, producing high levels of sound and flash reduction. However, the use of purely asymmetrical baffles is criticized as being detrimental to the accuracy of the firearm. The first baffle, known as the blast baffle, absorbs the brunt of the high temperature and high pressure propellant gases. By being symmetrical, this baffle provides a more stable environment for the projectile to pass through. The projectile is then less affected by turbulence created in the gas flow by the asymmetrical baffles. Flat, conical, and other shape symmetrical baffles are disclosed. The baffles are retained by spacer elements disposed therebetween. The end caps are secured by a screw threads, welding, or other means.

U.S. Pat. No. 7,931,118 discloses a baffle for sound suppression. The baffle includes a proximal face and a distal face, with an adjoining wall therebetween. The adjoining wall includes a borehole, at least one opening in the wall itself, and at least one opening from the borehole into at least one of two expansion chambers defined by the baffle. The baffle appears to be generally asymmetrical. The performance of symmetrical baffles is criticized as being poor by this patent. The baffle may be made by either machining from a single piece of metal, or by welding, fastening, or otherwise securing baffles to each other.

U.S. Pat. No. 8,424,635 discloses a firearm suppressor with relationally rotated spacers disposed between baffles. The baffle stack can be formed as a single member, which is described as milled from a single piece of material, or having each piece joined together. Alternatively, the baffle stack may include several members that are positioned next to each other. The most preferred angle of rotation between adjacent spacers appears to be approximately 137.5°. Rotation of the spacers with respect to each other is asserted to provide structural strength as well as enhanced sound dampening. Various baffle shapes are mentioned.

U.S. Pat. No. 7,587,969 discloses an asymmetrical firearm silencer with coaxial elements. The silencer includes a cylindrical housing having front and rear end caps. Alternating serially placed baffles of symmetrical or slanted orientation are provided between coaxial spacers. The baffles may include steps, ridges, shingles, fish scales, or similar structures to increase the surface area of the baffle. K and M style baffles are also disclosed. The first baffle may have a larger bullet opening and subsequent baffles, which is asserted to enhance accuracy by inducing less bullet yaw. The baffles can be made from resins, polymers, steel, titanium, aluminum, and any alloy thereof. Alternatively, the baffles may be made of heat conducting or heat absorbing materials such as aluminum, chromium, molybdenum, stainless steel, ceramic, plastics, carbon fiber, or other composites. The outer tubing can be made from carbon fiber or other heat conducting or composite material. The spacers can also be made from carbon fiber, ceramics, or other heat conducting, heat resistant, or composite material. Some examples of the spacers may be made from square tubing in contact with the outer casing. This provides chambers between the flat sides of the square tubing and the round outer casing of the silencer. Holes cut within the spacer permit yes to pass into the area between the spacer and the outer housing. The initial baffle is angled less than subsequent baffles with respect to the longitudinal axis of the silencer to resist deviation of the projectile from the point of aim as well as to increase the size of the initial chamber. Similar silencers are disclosed in U.S. Pat. Nos. 7,874,238 and 8,096,222. The claims of U.S. Pat. No. 8,096,222 should be kept in mind as the baffle design is enhanced.

U.S. Pat. No. 8,579,075 discloses a silencer with cone shaped baffles having flutes defined therein. The flutes within the walls of the cone shaped baffles are asserted to increase the baffle chamber area, increasing the effectiveness of the silencer.

US 2015/0292829 discloses a firearm suppressor. The suppressor includes a plurality of conical baffles, with each conical baffle including a cylindrical baffle wall at the distal end of the conical baffle. Subsequent conical baffles have a reduced diameter with respect to the previous conical baffles. The conical baffles are thus nested so that the subsequent baffles have a smaller diameter than the previous baffles, and are contained within the previous baffles. The first baffle compartments is thus almost to the entire length of the suppressor.

U.S. Pat. No. 4,588,043 discloses a sound suppressor for a firearm. The firearm includes a hollow cylindrical housing having disc shaped baffles therein. Entrance and exit plugs are attached to the cylindrical housing. Each baffle includes a central aperture and a secondary opening. A fluid such as grease may be placed within the sound suppressor. In use, gases that are directed away from the primary opening in each baffle will take longer to exit the volume within each expansion chamber, as well as causing a turbulence within each expansion chamber, thus controlling the expansion of gases entering the expansion chamber in a manner that causes the entering gases to take longer to exit the volume through the next baffle elements. Slanted sidewalls within the suppressor may be further utilized to deflect to the expanding gases within the suppressor.

U.S. Pat. No. 5,164,535 discloses a gun silencer. The silencer includes an outer tube having disc shaped baffles separated by intermediate spacers therein. The spacers include ports adjacent to the baffles, forming a passage from the interior of the spacers to the region between the spacers and the housing. Each baffle includes a pair of rear beveled diversion passages adjacent to and leading from a pair of front spacer ports into the baffle bores. Front beveled diversion passage pairs lead from the baffle bores to rear spacer ports. The diversion passages on the rear side of the baffle are 180° from the corresponding front diversion passages on the front side of the baffle, so that the rear diversion passages are directed towards the front diversion passages. When a firearm is discharged, some of the gases are directed into the circumferential outer chambers, while other portions of the guests are directed towards the interior of the suppressor.

U.S. D712,997 discloses a monolithic firearm suppressor. This design patent appears to disclose a baffle assembly wherein the entire baffle structure is made from a single piece.

U.S. D651,680 discloses a baffle arrangement for a sound suppressor. The baffle arrangement appears to be made from one-piece construction.

U.S. Pat. No. 8,794,376 discloses a flash suppressor system. The flash suppressor includes a plurality of times, with each time having a different mass, which is asserted to reduce sound as a result of expanding and combustion gases exiting the muzzle.

Accordingly, there is a need for a sound suppressor for a firearm having a simplified design for ease of manufacture. There is a further need for a sound suppressor for a firearm having a means of reducing backpressure in order to resist wear and tear on the firearm with which it is used, as well as fouling and malfunctions. There is an additional need for a sound suppressor having a means for reducing the thermal signature of the suppressor, thus aiding in the concealment of the shooter.

SUMMARY

Various above needs are met by various examples of a sound suppressor for a firearm. One example of the sound suppressor has a generally tubular housing defining an interior wall surface. The housing has an entrance end cap and an exit end cap. The entrance end cap defines a mounting structure for securing the sound suppressor to the muzzle of a firearm. A plurality of generally tubular baffles are disposed within the housing. Each tubular baffle defines a baffle wall. The tubular baffles are structured to cooperate with each other to form a baffle assembly. The baffle walls each define a first aperture and a second aperture opposite the first aperture. Each of the baffle walls define a pair of baffle wall edges that are structured to abut the interior surface of the housing around substantially the entire periphery of the baffle wall edges. The first aperture and second aperture of each baffle are substantially coaxial with the first aperture and second aperture of the other baffles within the sound suppressor.

Another example of a sound suppressor has an inner housing and a baffle disposed within the inner housing. The sound suppressor includes an outer housing. The outer housing has inner and outer walls defining a gap therein. The outer housing is sealed so that the gap is not in communication with outside air. The gap contains a gas or a vacuum.

These and other aspects of the invention will become more apparent through the following description and drawings.

BRIEF DESCRIPTION OF THE DRAWINGS

Like reference characters denote like elements throughout the drawings.

DETAILED DESCRIPTION

Figure 1:
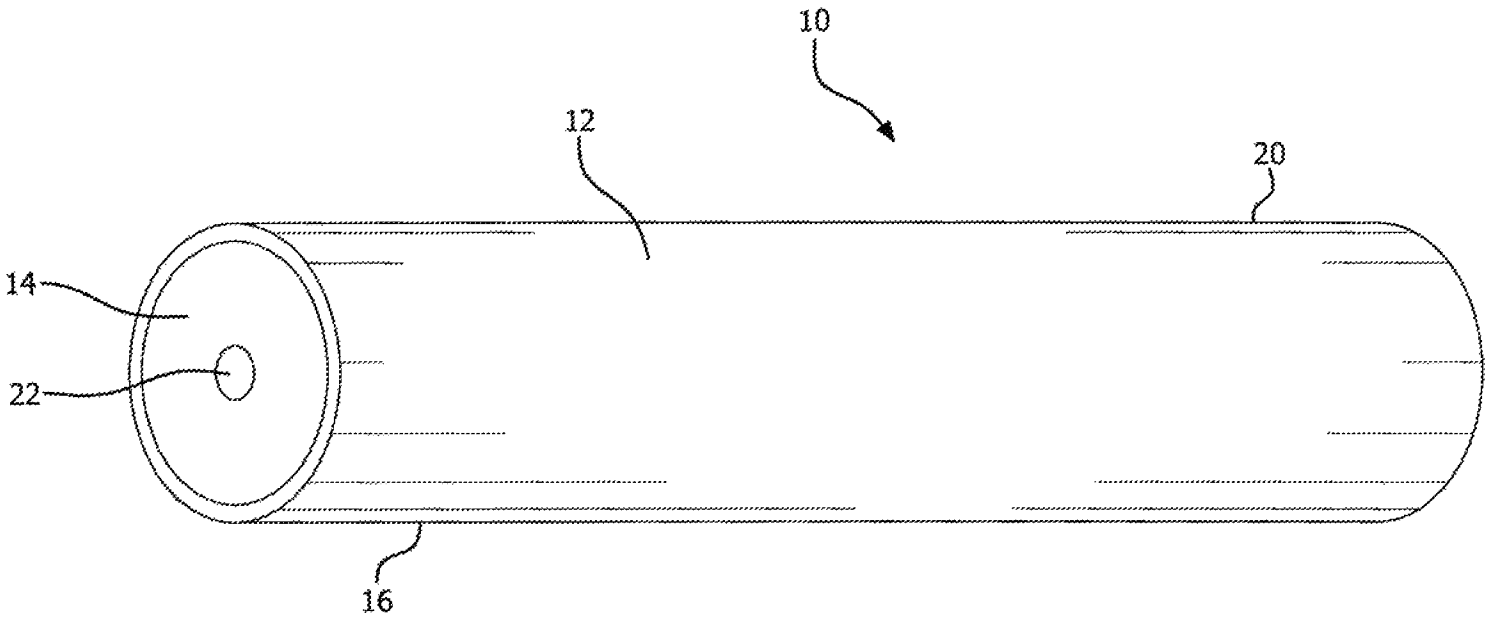
FIG. 1 is a front perspective view of a sound suppressor.
Figure 2:
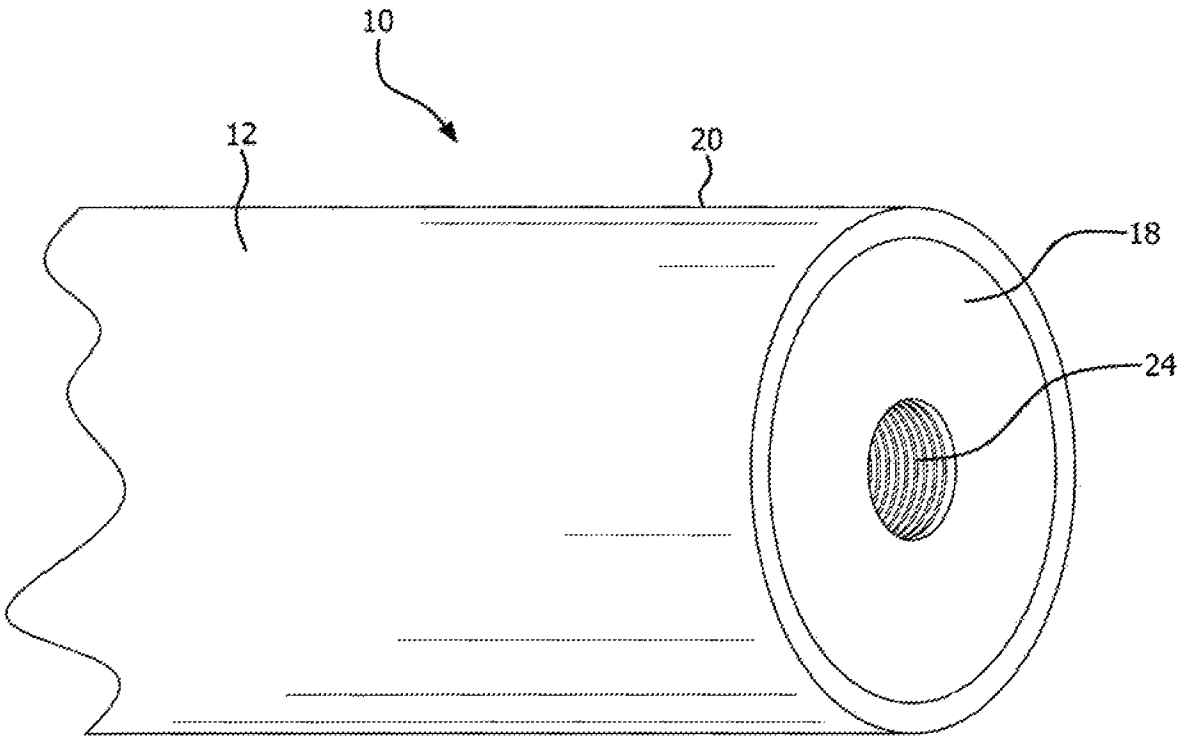
FIG. 2 is a rear perspective view of an entrance end of the suppressor of FIG. 1.

Referring to the drawings, an example of a sound suppressor 10 is illustrated. Although the terms front, rear, side, top, bottom, etc. may be used for convenience, any embodiment of a sound suppressor or component thereof can be rotated into any orientation, thus changing the portion which forms the top, side, etc. Referring to FIGS. 1-2, the sound suppressor 10 includes a generally tubular housing 12 having an exit end cap 14 secured at the exit end 16, and an entrance end cap 18 secured to the entrance and 20. The illustrated example of the housing 12 is generally cylindrical, but other shapes could be used without departing from the invention. The exit end cap 14 includes an aperture 22 defined generally centrally therein, for permitting a bullet to pass therethrough. The entrance end cap 18 includes a mounting structure for securing the sound suppressor 10 to the muzzle of a firearm. The illustrated example of the aperture 24 is threaded for attachment to an externally threaded gun barrel. The exit end cap 14 and entrance end cap 18 can be secured to the housing 12 using any conventional means, including but not limited to providing corresponding screw threads in one or both of the end caps 14, 18 and housing 12, press fitting one or both of the end caps 14, 18 into the housing 12, using adhesive to secure one or both of the end caps 14, 18 to the housing 12, welding one or both of the end caps 14, 18 to the housing 12, or making at least one of the end caps 14, 18 of unitary construction with the housing 12. Many examples of the sound suppressor 10 will include at least one end cap 14, 18 that is easily removable for cleaning or servicing the suppressor 10.

Figure 3:
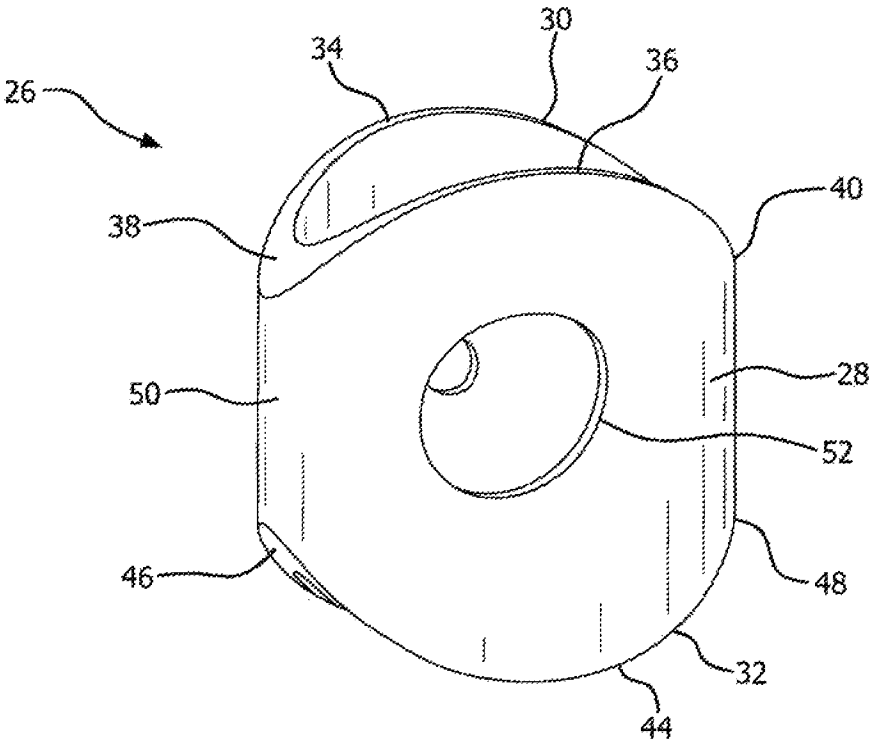
FIG. 3 is a perspective view of a baffle for the suppressor of FIG. 1, showing the entrance end of the baffle.
Figure 4:
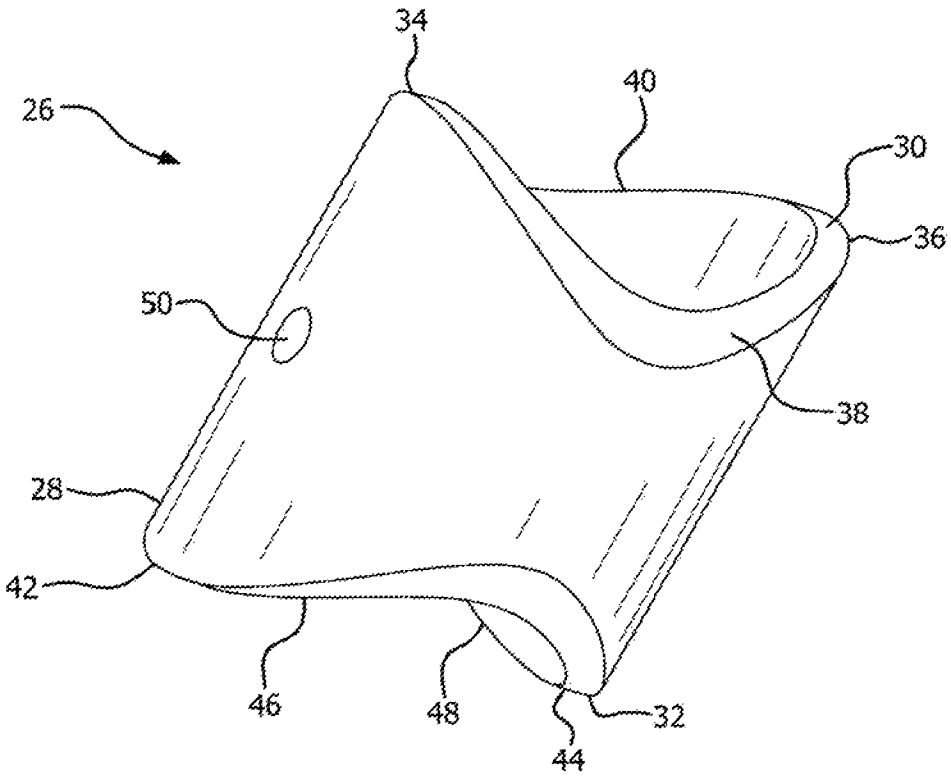
FIG. 4 is a perspective view of a baffle for the suppressor of FIG. 1, showing the side of the baffle.
Figure 5:
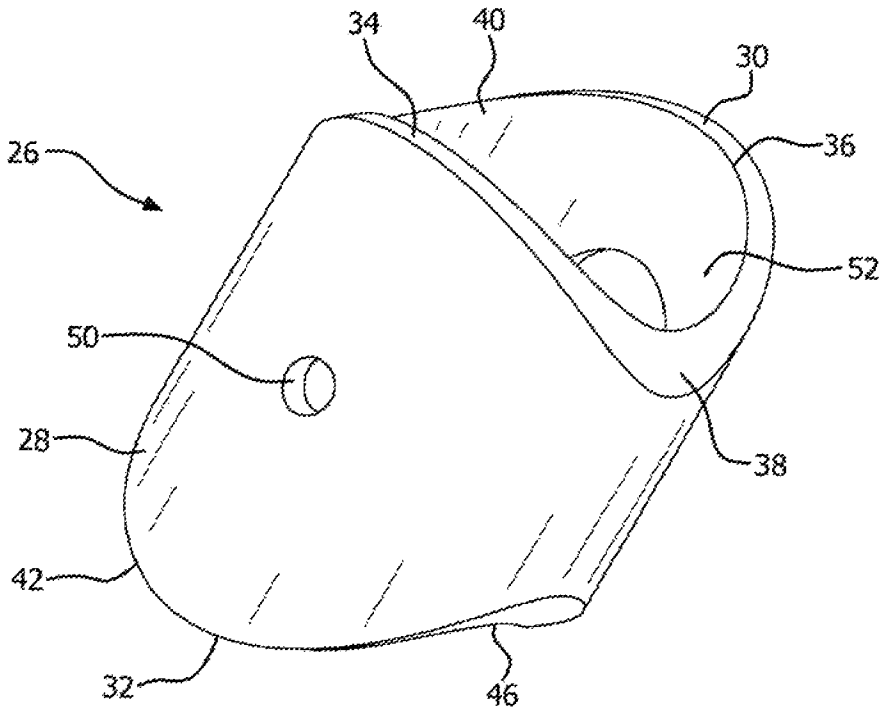
FIG. 5 is a perspective view of a baffle for the suppressor of FIG. 1, showing the exit end of the baffle.

Referring to FIGS. 3-5, an individual baffle 26 for use within the housing 12 is illustrated. The illustrated example of the baffle 26 is structured for use within a generally cylindrical housing 12. From the description herein, those skilled in the art will realize how to modify the baffle 26 to fit within other housing shapes without departing from the invention. The illustrated example of the baffle 26 is tubular and generally cylindrical, having an external wall 28. The ends of the external wall 28 defined curved surfaces 30, 32 that are structured to abut the inside of the housing 12 along substantially the entire periphery of the surfaces 30, 32. The curved surface 30 defines a pair of convex sections 34, 36, and a pair of concave sections 38, 40. Similarly, the curved surface 32 defines a pair of convex surfaces 42, 44, and a pair of concave surfaces 46, 48. An aperture 50 is defined within the wall 28, between convex the surface portions 34, 42. The aperture 50 is substantially the same diameter as the bullets that are anticipated to be utilized with the sound suppressor 10. An aperture 52 is also defined within the wall 28, between the convex surfaces 36, 44. The aperture 52 is larger than the aperture 50, and is structured to abut the wall 28 surrounding the aperture 50 of and adjacent baffle 26, with substantially all of the periphery of the aperture 52 abutting the wall 26 of the adjacent baffle 26 as will be described in greater detail below. The apertures 50, 52 are positioned within the wall 28 so that when the baffle 26 is placed within a housing 26 as described below, the apertures 50, 52 are aligned with a central axis of the tube 12, so that a bullet may pass unimpeded therethrough.

Continuing to refer to FIGS. 3-5 but with particular reference to FIG. 4, the end surfaces 30, 32 of the illustrated example of the baffle 26 are structured to position the baffle 26 at an angle from perpendicular within the housing 12. In the illustrated example, the convex surface portion 42 of the surface 32 is more pronounced than the opposing convex surface portion 34 of the surface 30. Similarly, the convex surface portion 36 of the surface 30 is more pronounced than the convex surface portion 44 of the surface 32. In the illustrated example, the baffle 26 is structured to be inserted into the housing 12 so that the wall 28 of the baffle 26 will form an angle of approximately 10° from perpendicular with respect to the housing 12. Alternatively, the wall 28 of the baffle 26 may form an angle less than 10° from perpendicular, may be perpendicular to the housing 12, or may form an angle greater than 10° from perpendicular, without departing from the invention.

Figure 6:
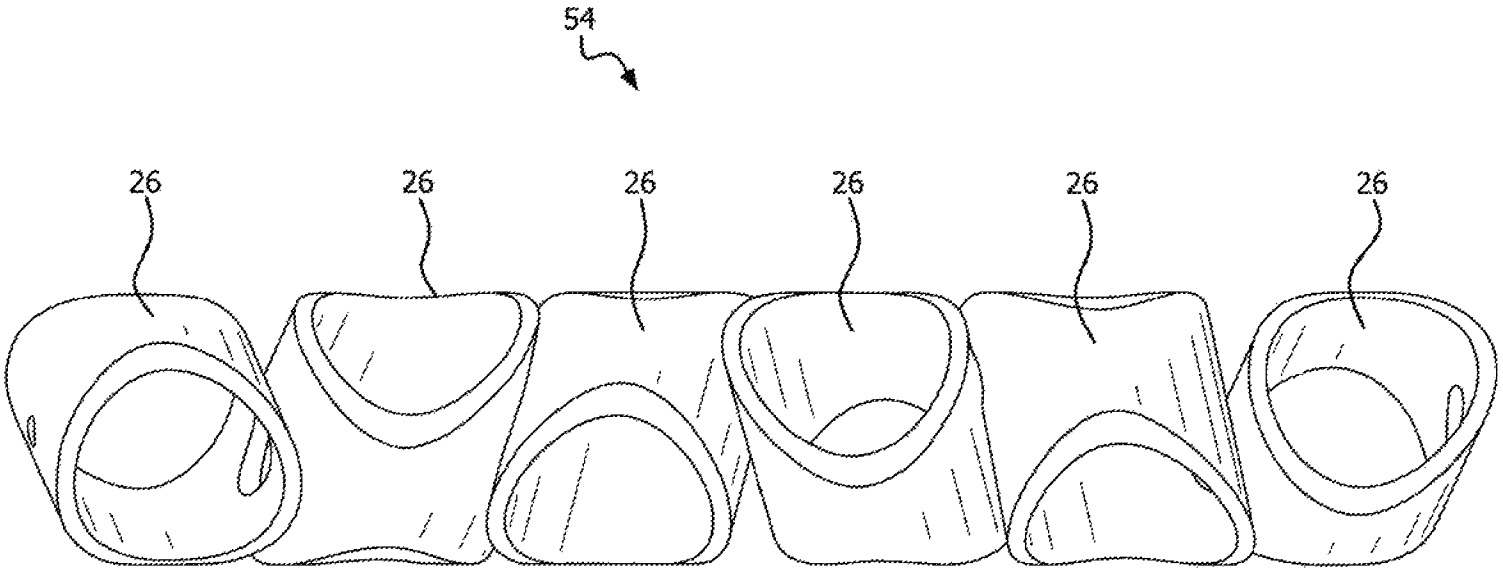
FIG. 6 is a side perspective view of a baffle assembly for the suppressor of FIG. 1.

Referring to FIG. 6, a baffle assembly 54 for use in the suppressor 10 is illustrated. The baffle assembly 54 includes a plurality of individual baffles 26, with the illustrated example including six baffles 26. A greater or lesser number of baffles 26 may be used without departing from the invention. Each of the baffles 26 is placed within the housing 12 (not shown for clarity) with the surfaces 30, 32 of the cylinder wall 28 abutting the inside surface of the housing 12. Each of the adjacent baffles 26 are inserted into the housing 12 so that the aperture 52 of one baffle 26 will abut the wall 28 surrounding the aperture 50 of the adjacent baffle 26. In the illustrated example, the aperture 52 is the entrance aperture, and the aperture 50 is the exit aperture. However, these apertures can be reversed without departing from the invention.

Figure 7:
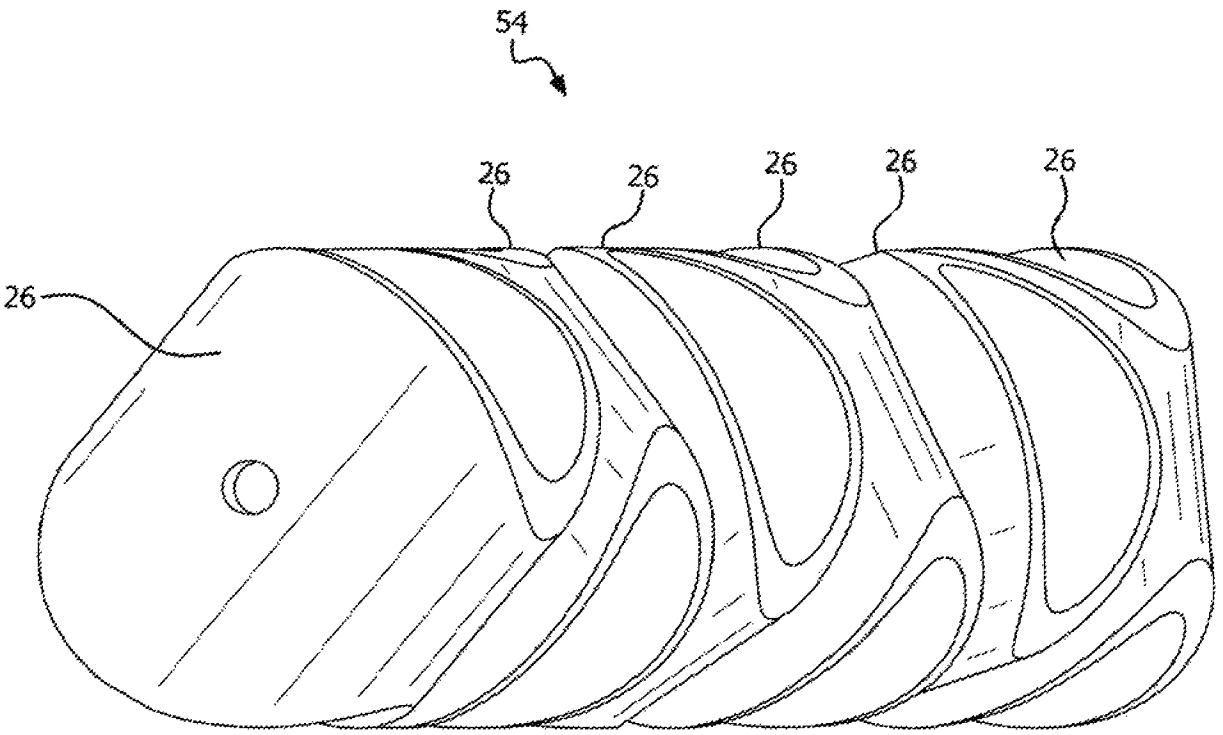
FIG. 7 is a front perspective view of a baffle assembly for the suppressor of FIG. 1.
Figure 8:
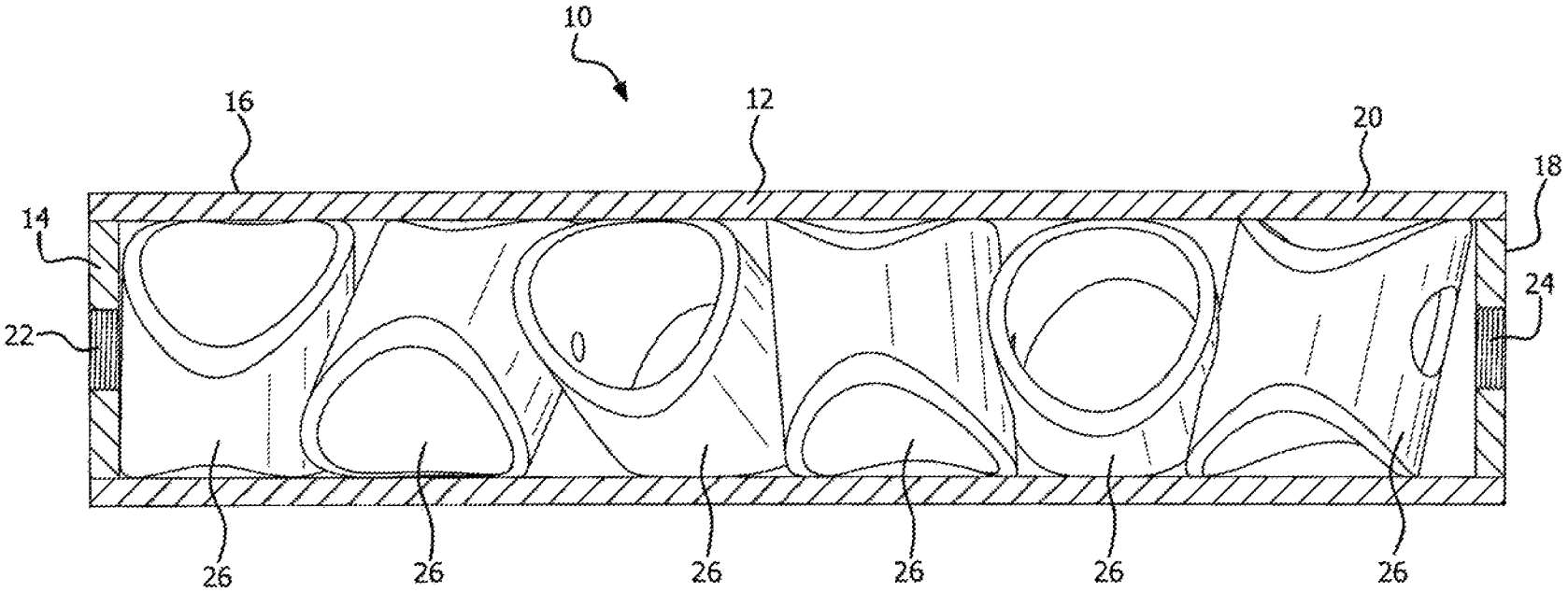
FIG. 8 is a side cross-sectional view of the sound suppressor of FIG. 1.

Referring to FIGS. 6-8, each of the baffles 26 is rotated around the central axis of the housing 12 with respect to the adjacent baffles 26. In the illustrated example, the degree of rotation between adjacent baffles is a little less than 90°. In other examples, the degree of rotation between adjacent baffles may be about 30°. In either case, the angle of the baffle walls 28, as well as the rotation between adjacent baffles 26, is selected to maximize internal turbulence caused by sound and pressure waves interfering with each other, and thus maximize sound and flash reduction, while also minimizing any effect on the accuracy of the firearm with which the silencer is utilized. In the illustrated example of a cylindrical tube 12 and cylindrical baffles 26, the angle of the baffle walls 28 with respect to the tube 12 will also affect the angle of the baffles 26 with respect to each other around the central axis of the tube 12.

Some examples of the baffles 26 may include additional apertures, permitting sound and pressure waves to enter the space between the baffles 26 and the tube 12. This is anticipated to reduce back pressure within the sound suppressor 10, thus decreasing wear and tear on the firearm with which the sound suppressor 10 is utilized.

Some examples of the sound suppressor 10 may include an inner tube fitting inside of an outer tube 12. Some examples of the inner tube may be removed along with the baffle assembly 54, thus facilitating cleaning or maintenance of the sound suppressor 10.

Figure 9:
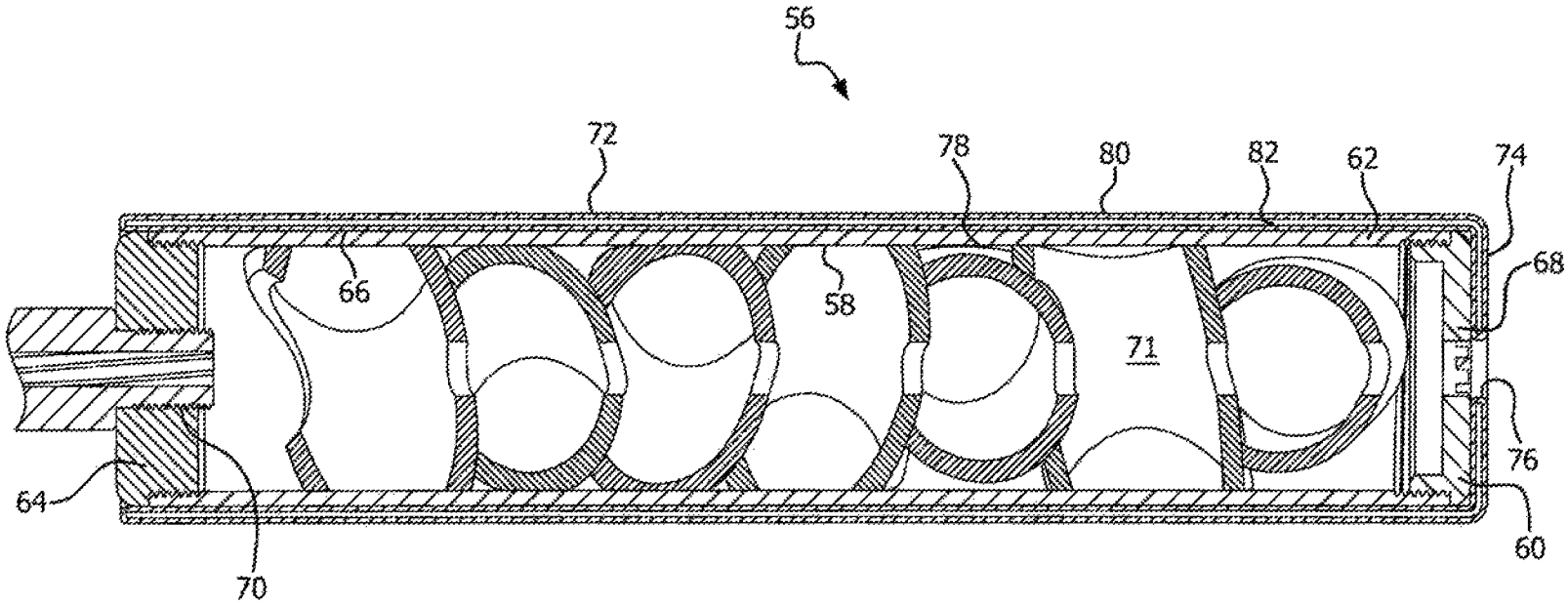
FIG. 9 is a side cross sectional view of another example of a sound suppressor.

Another example of a suppressor is the suppressor 56 illustrated in FIG. 9. The sound suppressor 56 includes a generally tubular inner housing 58 having an exit end cap 60 secured at the exit end 62, and an entrance end cap 64 secured to the entrance and 66. The illustrated example of the inner housing 58 is generally cylindrical, but other shapes could be used without departing from the invention. The exit end cap 60 includes an aperture 68 defined generally centrally therein, for permitting a bullet to pass therethrough. The entrance end cap 64 includes a mounting structure for securing the sound suppressor 56 to the muzzle of a firearm. The illustrated example of the aperture 70 is threaded for attachment to an externally threaded gun barrel. The exit end cap 60 and entrance end cap 64 can be secured to the housing 58 using any conventional means, including but not limited to providing corresponding screw threads in one or both of the end caps 60, 64 and housing 58, press fitting one or both of the end caps 60, 64 into the inner housing 58, using adhesive to secure one or both of the end caps 60, 64 to the housing 58, welding one or both of the end caps 60, 64 to the housing 58, or making at least one of the end caps 60, 64 of unitary construction with the housing 58. Many examples of the sound suppressor 56 will include at least one end cap 60, 64 that is easily removable for cleaning or servicing the suppressor 56.

The suppressor of FIG. 9 includes a baffle assembly 71 disposed within the inner housing. Although the example of the suppressor 56 illustrated in FIG. 9 includes the baffles which are described above and illustrated in FIGS. 1-8, other baffle assemblies may be used with the suppressor 56 of FIG. 9 without departing from the invention depicted therein.

The suppressor 56 also includes an outer housing 72 that may be secured over the inner housing 58. The outer housing 72 is generally tubular, and has a shape that corresponds to the shape of the inner housing 58, with the outer housing 72 having an internal diameter or width that substantially corresponds to the outer diameter or width of the inner housing 58, so that the outer housing 72 may be placed over the inner housing 58. The outer housing 72 includes a generally closed front end 74 having an aperture 76 defined therein, with the aperture 76 being substantially concentric with and at least as large as the aperture 68, so that a bullet passing through the aperture 68 will also pass through the aperture 76 without interference.

The outer housing 72 includes an inner wall 78 and outer wall 80, with a gap 82 formed therebetween. In the illustrated example, the gap 82 extends not only along substantially the entire sides of the outer housing 72, but also across substantially all of the front end 74 with the exception of the aperture 76. In the illustrated example, the outer housing 72 is sealed so that the gap 82 is not in communication with the outside air. Examples of the outer housing 72 may be filled with air or a specific gas, or may be evacuated so that a low pressure gas or substantially complete vacuum exists in the gap 82. Thus, the outer housing 72 provides thermal insulation for the suppressor 56, thus reducing the ability of an individual using an infrared optical device such as an infrared night vision device to locate the shooter by spotting the heat emitted by the suppressor after shooting.

Some examples of the outer housing 72 may be removably secured to the inner housing 58, so that the shooter may optionally attach or remove the outer housing 72 when using the suppressor 56. The shooter may thus decide whether heat dissipation or enhanced concealment is more important, installing or removing the outer housing 72 accordingly. A variety of conventional structures may be utilized to removably secure the outer housing 72 to the inner housing 58. One example would include external screw threads on the inner housing 58, with corresponding internal threads on the outer housing 72. Some examples of these screw threads may be structured so that the outer housing 72 is turned in the opposite direction as the suppressor 56 would be turned to install the suppressor 56 to a firearm, thus facilitating removal of the outer housing 72. Another example could be a clip mechanism secured to the outer housing 72, and structured to engage the inner housing 58 when the outer housing 72 is installed on the inner housing 58. Yet another example could include mating male and female connectors at the forward end of the suppressor 56 to ensure substantially precise alignment of the inner housing 58 and outer housing 72.

The housing and baffles of the sound suppressors described herein can be made from a variety of materials. In some of the illustrated examples, the housing and baffles are made from titanium tubing. Examples of other suitable materials include aluminum alloy tubing, or tubing made from other metals. Components of examples of the sound suppressor that are made from metal tubing can be made by simply cutting such metal tubing on a seven axis CNC mill. Alternatively, the various polymers could also be utilized. Silicon nitride having strengthening fibers or "whiskers" therein is one example material.

A variety of modifications to the above-described embodiments will be apparent to those skilled in the art from this disclosure. Thus, the invention may be embodied in other specific forms without departing from the spirit or essential attributes thereof. The particular embodiments disclosed are meant to be illustrative only and not limiting as to the scope of the invention. The appended claims, rather than to the foregoing specification, should be referenced to indicate the scope of the invention.

What is claimed is:

1. A sound suppressor for a firearm, the firearm having a barrel defining a muzzle, the sound suppressor comprising:

a tubular housing defining a central axis and an interior surface, the housing having an entrance end cap and an exit end cap, the entrance end cap defining a mounting structure for securing the sound suppressor to the muzzle;

a plurality of separate tubular baffles disposed within the housing, each tubular baffle defining a baffle wall, each tubular baffle being structured to abut each adjacent tubular baffle at a central portion of each tubular baffle wall to form a baffle assembly, the baffle walls each defining a first aperture and a second aperture opposite the first aperture, each of the baffle walls defining a first baffle wall edge and second baffle wall edge, the first baffle wall edge and second baffle wall edge being structured to abut opposing portions of the interior surface of the housing around substantially the entire periphery of each baffle wall edge, the first baffle wall edge defining a first convex surface and a second convex surface opposite the first convex surface, the second baffle wall edge defining a third convex surface and fourth convex surface opposite the third convex surface, the first convex surface and third convex surface being on opposite sides of the first aperture, the second convex surface and fourth convex surface being on opposite sides of the second aperture, the first convex surface extending outward farther than the third convex surface, the fourth convex surface extending outward farther than the second convex surface, whereby each tubular baffle wall is angled from perpendicular to the central axis of the housing, the first aperture and second aperture of each tubular baffle being substantially coaxial with the first aperture and second aperture of the other tubular baffles within the sound suppressor.

2. The sound suppressor of claim 1, wherein the housing is generally cylindrical.

3. The sound suppressor of claim 2, wherein each tubular baffle is generally cylindrical.

4. The sound suppressor of claim 1, wherein each tubular baffle is generally cylindrical.

5. The sound suppressor according to claim 1, wherein the baffle wall defined by each tubular baffle is a single baffle wall forming the entire baffle.

6. The sound suppressor of claim 5, wherein each tubular baffle wall is rotated about the central axis of the housing with respect to each wall of each adjacent baffle, whereby each tubular baffle wall is angled with respect to each wall of each adjacent baffle.

7. The sound suppressor of claim 5, wherein each baffle wall is generally cylindrical.

8. The sound suppressor of claim 1, wherein each tubular baffle wall is rotated about the central axis of the housing with respect to each wall of each adjacent baffle, whereby each tubular baffle wall is angled with respect to each wall of each adjacent baffle.

9. The sound suppressor of claim 1, wherein:

the first convex surface extends outward farther than the second convex surface; and the fourth convex surface extends outward farther than the third convex surface.

10. A sound suppressor for a firearm, the firearm having a barrel defining a muzzle, the sound suppressor comprising:

a tubular housing defining a central axis and an interior surface, the housing having an entrance end cap and an exit end cap, the entrance end cap defining a mounting structure for securing the sound suppressor to the muzzle;

a plurality of separate tubular baffles disposed within the housing, each tubular baffle defining a baffle wall, each tubular baffle being structured to abut each adjacent tubular baffle to form a baffle assembly, the baffle walls each defining a first aperture and a second aperture opposite the first aperture, each of the baffle walls defining a first baffle wall edge and second baffle wall edge, each baffle wall edge being structured to abut the interior surface of the housing around substantially the entire periphery of the baffle wall edge, the first aperture and second aperture of each tubular baffle being substantially coaxial with the first aperture and second aperture of the other tubular baffles within the sound suppressor, each second aperture of each baffle being sufficiently large to abut the baffle wall surrounding the first aperture of an adjacent baffle around substantially the entire periphery of the second aperture.

11. The sound suppressor of claim 10, wherein each baffle wall is angled from perpendicular with respect to the central axis of the housing.

* * * * *